United States Patent [19]

Williams

[11] Patent Number: 4,601,670

[45] Date of Patent: Jul. 22, 1986

[54] HAND PUPPET

[76] Inventor: Sharon L. Williams, Rte. 3 Box 149, Covington, Tenn. 38019

[21] Appl. No.: 751,482

[22] Filed: Jul. 3, 1985

[51] Int. Cl.[4] ..... A63H 3/14

[52] U.S. Cl. ..... 446/327; 446/310

[58] Field of Search ..... 446/327, 328, 329, 310, 446/309, 308, 359; D21/151, 152, 153

[56] References Cited

U.S. PATENT DOCUMENTS 2,725,670 12/1955 Hodes ..... 446/327

3,667,155 6/1972 Freelander ..... 446/310

3,763,591 10/1973 Fontana ..... 446/310 X

*Primary Examiner*—Mickey Yu

*Attorney, Agent, or Firm*—Walker & McKenzie

[57] ABSTRACT

A hand puppet for amusing a child or the like including a soft, machine washable material in a manner as to allow a child to play with the puppet without being harmful to oneself. The puppet includes a base member, a top member and a body member that is selectively movable between an extended position and a concealed position.

1 Claim, 7 Drawing Figures

HAND PUPPET

BACKGROUND OF THE INVENTION

1. Field of the Invention

The present invention relates, in general, to a child's toy, more specifically, to a hand puppet.

2. Description of the Prior Art

Many devices have heretofore been developed that relate to hand puppets or the like for children. See, for example, the following U.S. patents: U.S. Pat. No. 2,655,762 granted to Burke and U.S. Pat. No. 1,768,334 granted to Stein et al. None of the above patents disclose or suggest the present invention.

SUMMARY OF THE INVENTION

The present invention is directed toward an improved child's toy. The concept of the present invention is to provide a soft, flexible hand puppet that is movable between an extended position in which the body member is extended above the box-like base member and a concealed position in which the body member is concealed within the interior of the box-like base member.

An object of the present invention is to provide a soft child's toy that would not harm a small child.

The hand puppet of the present invention comprises, in general, a box-like base member having a front side wall, a back side wall, a right side wall and a left side wall and having an interior area within the base member, a top member fixedly attached to the back side wall and a body member having animated body features, such as hands and a head with the lower portion of the body member being securely attached to the interior of the front side wall, back side wall, right side wall and left side wall of the base member.

DESCRIPTION OF THE PREFERRED EMBODIMENT

Figure 1:
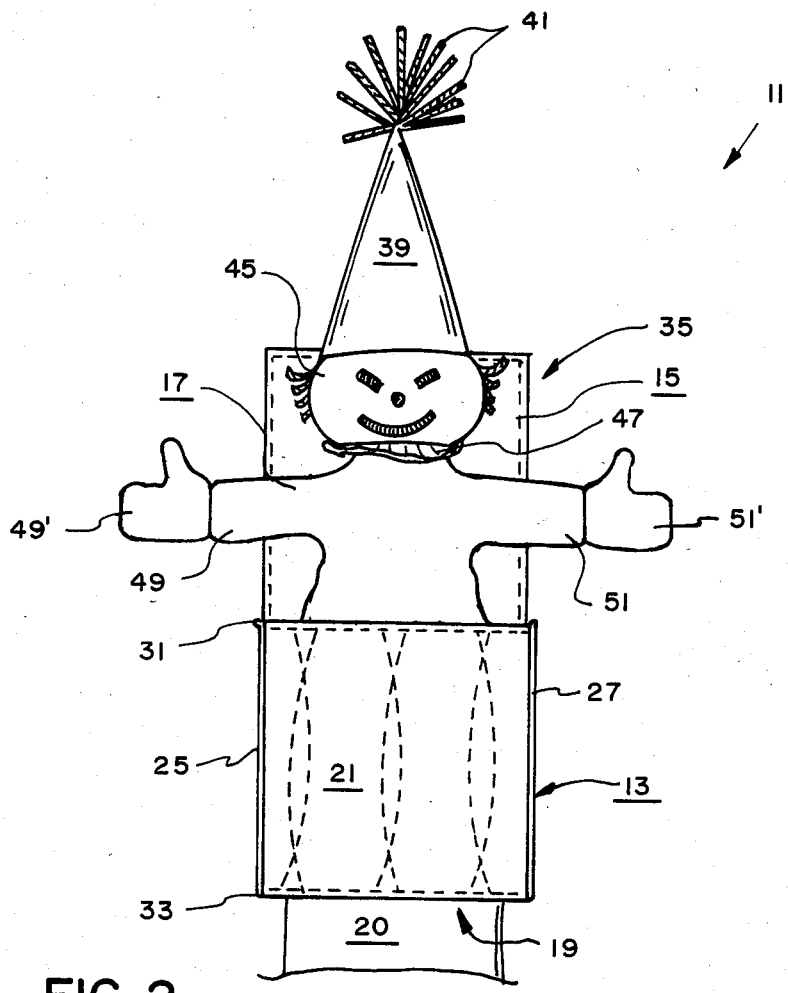
FIG. 1 is a front elevational view of the hand puppet of the present invention with the body member and top member in an open position.

The hand puppet 11 of the present invention includes, in general, a base member 13, a top member 15 and a body member 17 having an interior opening 19 for receiving a hand 20 of the user (see, in general, FIG. 1).

The base member 13 is defined by a box-like unit including a front side wall 21, a back side wall 23, a right side wall 25 and a left side wall 27 with the edges of the various side walls joined together to form a unit.

More specifically, the front side wall 21, the back side wall 23, the right side wall 25 and the left side wall 27 are constructed of a substantially flat square sheet of quilt-like material with the vertical edges being sewed together by stitches 29 disposed vertically along the upwardly extending edges thereof. The base member 13 includes a first end 31 defined as the top portion thereof and a second end 33 defined as the bottom portion thereof.

Figure 2:
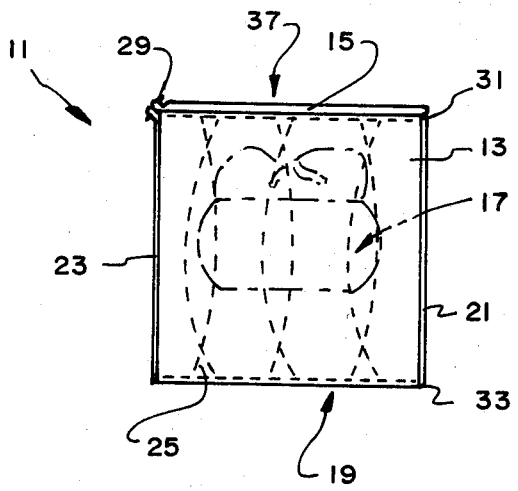
FIG. 2 is a right side elevational view thereof with the body member shown in phantom lines concealed within the base member thereof and with the top member in a closed position.
Figure 3:
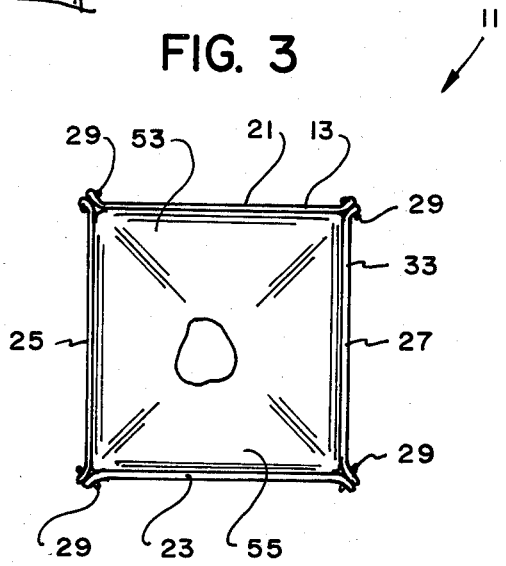
FIG. 3 is a bottom plan view thereof.
Figure 5:
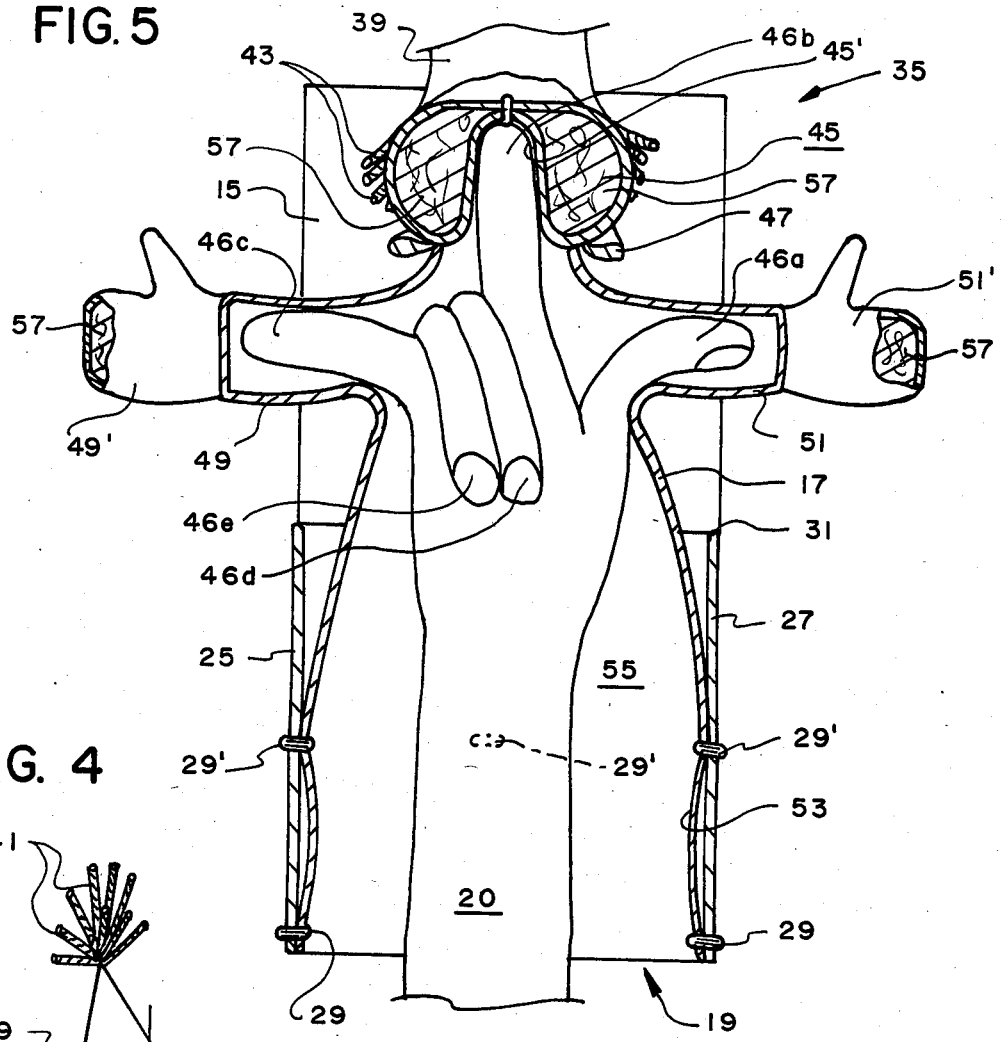
FIG. 5 is an enlarged sectional view substantially as taken on line V—V of FIG. 4 with portions broken away for clarity.
Figure 4:
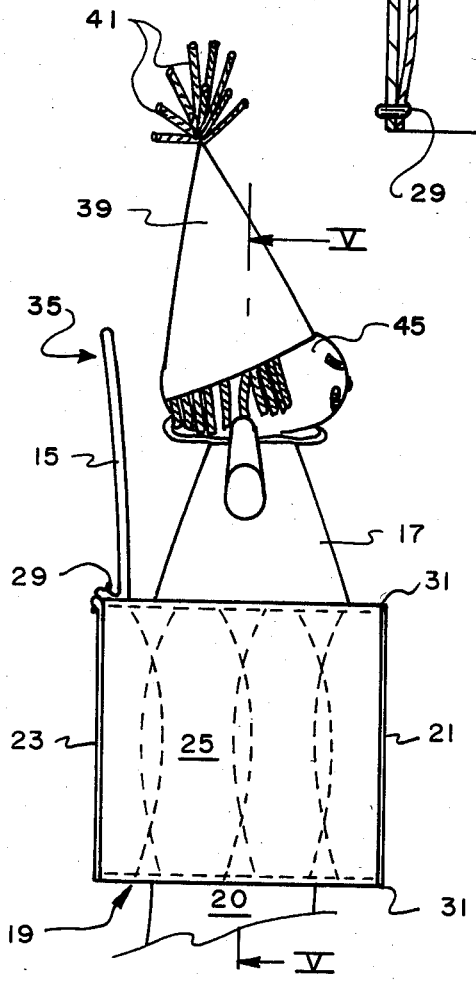
FIG. 4 is a right side elevational view thereof with the body member and top member in an open position.
Figure 6:
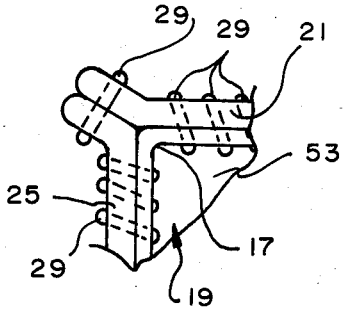
FIG. 6 is an enlarged bottom view of the top left hand corner thereof.
Figure 7:
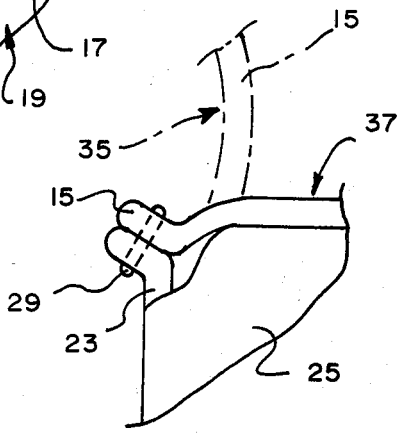
FIG. 7 is an enlarged right side elevational view of the top left hand corner thereof with a portion of the top member shown in phantom lines and with a portion of the right side broken away for clarity.

The top member 15, constructed of a substantially flat square sheet of quilt-like material of the type well known to those skilled in the art, is attached to the first end 31 of the back side wall 23 by a plurality of stitches 29 extending horizontally along one edge thereof (see FIGS. 2 and 6). The top member 15 is selectively movable between an open position 35 in which the top member 15 is substantially vertically in line in relationship with the back side wall 23 (see, in general, FIGS. 1, 4 and 5) and a closed position 37 in which the top member 15 is substantially perpendicular relative to the side walls 21, 23, 25 and 27 and covers the first end 31 of the base member 13 (see FIG. 2).

The body member 17 includes an upper portion that resembles a clown outfit or the like having a hollow pointed hat 39 of brightly colored cloth with a tassel or tuft 41 of yarn attached to the top thereof and having hair 43 comprised of a colorful yarn protruding outwardly from underneath the lower end of the hat 39 and a head 45 having brightly colored yarn for the eyes, nose and mouth. The body member 17 also includes a wide ruffled collar 47 attached beneath the head 45. The body member 17 also includes a right arm 49 with a stuffed hand 49' attached thereto and a left arm 51 with a stuffed hand 51' attached thereto. The right arm 49, left arm 51 and the lower portion 53 is comprised of a soft colored cloth or the like having a hollow interior 55 thereof for receiving the hand 20 of the user through the interior opening 19 thereof. The use of the hand will hereinafter become apparent. The lower portion 53 of the body member 17 coincides with the interior opening 19 of the base member 13 and is attached thereto by a plurality of stitches 29 along the inside edge thereof. A single stitch 29' is centrally disposed substantially in the middle of the front side wall 21, the back side wall 23, the right side wall 25 and the left side wall 27 to keep the body member 17 within the base member 13 when the body member 17 is placed in a concealed position.

The right hand 49' and left hand 51' of the body member 17 is filled with a stuffing material 57 of the type well known to those skilled in the art, such as cotton or polyester type material and is lined with soft cloth lining. The hands 49' and 51' are securely sewn respectively to the outwardly extending end of the arms 49 and 51. A portion of the head 45 of the body member 17 is filled with a stuffing material 57, such as cotton or polyester material and is lined with a soft cloth lining of the type well known to those skilled in the art. The head 45 includes a hollowed interior 45' running vertically within the head 45 for receiving the finger 46 of the user's hand 20 (see FIG. 5). The hand 20 may be thrust upwardly through the interior opening 19 of the second end 33 of the base member 13 with the tip of the thumb **46*a* being inserted into the left arm 51, with the index finger 46*b* inserted into the hollowed interior 45' of the head 45, with the tip of the little finger 46*c* inserted into the right arm 49, and with the middle finger 46*d* and ring finger 46*e* being bent downwardly toward the palm of the hand 20, therefore allowing manipulation of the body member 17 producing an illusion of being life-like. The body member 17 may be stowed within the base member 13 with the top member 15 in the closed position 37 (see FIG. 2). By the user moving his hand quickly upwardly the body member 17 may jump out of the base member 13** in a manner substantially similar to a well-known child's toy known as the Jack-in-the Box.

The present invention provides the user with a soft, machine washable hand puppet that infants and small children may play with without fear of injury. The hand puppet contains no breakable parts that a child may be cut on or may swallow.

Although the present invention has been described and illustrated with respect to preferred embodiment thereof and a preferred use therefor, it is not to be so limited since changes and modifications can be made therein which are within the full intended scope of the invention.

I claim:

1. A device for use with a hand for the amusement of children, said device comprising:

(a) a base member having box-like upwardly extending side walls having a first end which is the top thereof, a second end which is the bottom thereof, and having a hollow interior therethrough; said side walls of said base member including a front side wall, a back side wall a right side wall and a left side wall; said front side wall, said back side wall, said right side wall and said left side wall including edges thereof which are securely attached together to define said base member;

(b) a top member attached to said first end of said base member and movable between an open position and a closed position in which said first end is closed; and (c) a body member having a hollow interior, said body member including a head, a right arm, a left arm and a lower portion attached to the interior of said base member adjacent said second end thereof; said first end of said back side wall and said top member being attached together allowing said top member to move between an open position in which said top member is substantially aligned with said back side wall and a closed position in which said top member is covering said first end of said front side wall, right side wall, left side wall and encloses said body member within said interior of said base member; said front side wall, said back side wall, said right side wall, said left side wall, said top member and said body member being comprised of a soft, flexible material and joined together by strands of thread.

* * * * *